US009038334B2

(12) United States Patent
Bren

(10) Patent No.: US 9,038,334 B2
(45) **Date of Patent: *May 26, 2015**

(54) WATER INTRUSION PREVENTION METHOD AND APPARATUS

(71) Applicant: Thomas Bren, Maple Plain, MN (US)

(72) Inventor: Thomas Bren, Maple Plain, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/285,786

(22) Filed: May 23, 2014

(65) Prior Publication Data

US 2014/0260012 A1 Sep. 18, 2014

Related U.S. Application Data

(60) Continuation of application No. 13/653,007, filed on Oct. 16, 2012, now Pat. No. 8,745,939, which is a division of application No. 11/584,328, filed on Oct. 18, 2006, now Pat. No. 8,302,353, which is a continuation-in-part of application No. 11/251,221, filed on Oct. 14, 2005, now abandoned.

(60) Provisional application No. 60/619,343, filed on Oct. 15, 2004.

(51) Int. Cl.

| | |
|---|---|
| ***E06B 3/00*** | (2006.01) |
| ***E06B 1/58*** | (2006.01) |
| *E06B 1/62* | (2006.01) |

(52) U.S. Cl.

CPC ..... *E06B 1/58* (2013.01); *E06B 2001/628* (2013.01)

(58) Field of Classification Search

USPC ..... 52/204.5, 204.55, 204.56, 208, 745.15, 52/745.16

See application file for complete search history.

(56) References Cited

U.S. PATENT DOCUMENTS

| | | | | | |
|---|---|---|---|---|---|
| 1,352,732 | A | * | 9/1920 | Egerton | 49/493.1 |
| 1,741,781 | A | * | 12/1929 | Lane | 49/436 |
| 1,798,720 | A | * | 3/1931 | Burns | 49/495.1 |
| 2,293,292 | A | * | 8/1942 | Goellner | 49/489.1 |
| 3,140,517 | A | * | 7/1964 | Richter | 49/489.1 |
| 3,385,001 | A | * | 5/1968 | Bordner | 49/489.1 |
| 4,204,373 | A | | 5/1980 | Davidson | |

(Continued)

FOREIGN PATENT DOCUMENTS

| | | | | |
|---|---|---|---|---|
| DE | 10109692 | A1 | 11/2002 | |
| EP | 1213430 | A2 * | 6/2002 | E06B 1/62 |

(Continued)

OTHER PUBLICATIONS

Dec. 6, 2012 USPTO Office Action (U.S. Appl. No. 13/653,007)—Our Matter 4914.

(Continued)

*Primary Examiner* — Adriana Figueroa
(74) *Attorney, Agent, or Firm* — Beck Tysver Evans PLLC

(57) ABSTRACT

A method and device are presented that creates a channel adjacent a nailing flange of a window in between the window and the rough opening that receives the window. The channel is created by establishing a barrier that prevents foam insulation inserted into the space between the window and the rough opening from reaching the nailing flange. The channel then ensures proper drainage of water that enters the window cavity down to the window sill. A gasket is presented that can be attached to the window or the rough opening to create the barrier. Alternatively, a disintegrating object or a wicking object can be used to impede the flow of insulation foam and to create the appropriate channel. The present invention is equally applicable to doors or other framed objects received into the exterior shell of a building.

13 Claims, 10 Drawing Sheets

(56) References Cited

U.S. PATENT DOCUMENTS

| | | | | | |
|---|---|---|---|---|---|
| 4,344,265 | A | * | 8/1982 | Davidson | 52/745.15 |
| 4,447,989 | A | * | 5/1984 | Mailand et al. | 49/482.1 |
| 4,510,715 | A | * | 4/1985 | Giguere | 49/489.1 |
| 4,606,147 | A | * | 8/1986 | DeWitt et al. | 49/434 |
| 4,691,477 | A | * | 9/1987 | Governale | 49/380 |
| 4,720,936 | A | | 1/1988 | Ellingson | |
| 4,995,207 | A | | 2/1991 | Powis | |
| 4,999,957 | A | * | 3/1991 | Kessler | 52/213 |
| 5,243,787 | A | | 9/1993 | Mott et al. | |
| 5,375,376 | A | * | 12/1994 | Scott | 49/480.1 |

FOREIGN PATENT DOCUMENTS

| | | | |
|---|---|---|---|
| EP | 14626540 | A2 | 6/2004 |
| WO | 2005010308 | A1 | 2/2005 |
| WO | 2005012681 | A1 | 2/2005 |

OTHER PUBLICATIONS

Jul. 10, 2013 USPTO Office Action (U.S. Appl. No. 13/653,007)—Our Matter 4914.

* cited by examiner

WATER INTRUSION PREVENTION METHOD AND APPARATUS

PRIORITY

This application is a continuation of U.S. patent application Ser. No. 13/653,007, filed Oct. 16, 2012 (the '007 application). The '007 application is itself a divisional application of U.S. patent application Ser. No. 11/584,328, filed on Oct. 18, 2006 (now U.S. Pat. No. 8,302,353), which in turn is a continuation-in-part of U.S. patent application Ser. No. 11/251,221, filed on Oct. 14, 2005, which in turn claims the benefit of U.S. Provisional Application No. 60/619,343, filed on Oct. 15, 2004.

FIELD OF THE INVENTION

The present invention relates to the field of building construction. More particularly, the present invention provides a method and apparatus that prevents water intrusion into the walls of the building around a window, door, or other framed object.

BACKGROUND OF THE INVENTION

A typical window 100 of the prior art is shown in FIG. 1. The window 100 may include one or more panes of glass 110, which may be embedded in a single sash, or in an upper and lower sash such as in a double-hung window. The sash is secured in a frame 120, which consists of two side jambs 130, a top jamb 140, and a sill 150. The window frame 120 is typically made from wood, vinyl, aluminum, or fiberglass, but may be made from any durable, rigid material.

Typically, a window is installed into a rough opening 200 in a house or building, as shown in FIG. 2. The rough opening 200 forms a window cavity 202 surrounded by a header 210, two sides 220, and a sill 230. The header 210 must be constructed sufficiently sturdy to support the necessary roof loads, since these loads cannot be supported by the window unit 100. This is especially important with large window units 100, or when a "window wall" is created with multiple windows side-by-side. The rough opening 200 has an interior side 240 and an exterior side 250 relative to the building itself. The sill 230 is sloped toward the exterior side 250 to allow water that makes its way to the sill 230 to drain out the exterior of the building. The height and width of the window cavity 202 is constructed larger than the height and width of the window frame 120; typically about three-quarters of an inch (approximately two centimeters) larger in each direction. This leaves an approximately three-eighth inch space (about one centimeter) between the window 100 and the rough opening 200 on each of the four exterior faces 160 (the top 120, sill 150, and both sides 130) of the window 100.

To hold the window unit 100 in place, the unit 100 is generally constructed with a nailing or installation flange 170 near the exterior edge on each of the four faces 160 of the window frame 120. FIG. 3 shows the window 100 of FIG. 1 sectioned along line 3-3, and shows the relationship of the nailing flange 170 versus the rest of the window frame 120 and the glass 110. FIG. 4 shows the same section of window 100, this time with the nailing flange 170 being used to secure the window frame 120 to one of the sides 220 of the rough opening 200. The window 100 is installed so that the nailing flange 170 is on the building exterior 250. Nails 300 are then placed through both the flange 170 and the side 220 of the rough opening 200. These nails 300 are used around the circumference of the window 100, preferably centering the window 100 in the opening 200.

Because the opening 200 is deliberately sized larger than the window 100, a space 310 is created between the opening 200 and the window. Modern construction techniques involve creating a vapor barrier between warm moist air inside a house and the outside, cooler air. To complete the vapor barrier, it is necessary to extend the vapor barrier from the rough opening 200 of the house framing to the window 100 itself. To accomplish this, foam 320 is inserted into space 310 around all four faces 160 of window 100. This foam 320 also serves to insulate this gap 310. Most window manufacturers carefully advise the window installers to take steps to prevent the expanding foam 320 from warping the window frame 120. In most cases, installers are instructed to use low expanding foam 320. In addition, installers are instructed to begin inserting the foam 320 at the nailing flange 170, but to avoid filling the entire space 310 all the way to the interior 240 of the rough opening 200 and window frame 120. This should allow the expansion of the foam 320 within space 310 without warping the window frame 120.

To prevent water leakage under the nailing flange 170, installers will generally place a sealant between the flange 170 and the exterior surface 250 of the rough opening 200. Sill flashing is used on the sill 230 to provide a moisture barrier to prevent water that enters the window cavity 202 after installation of the window 100 from entering the wall under the sill 230. Moisture in the window opening 202 will ideally pool on the sill flashing, where it will generally drain down the non-wood side of the exterior building paper. Any moisture that does not drain off the sill will remain on the sill flashing until it evaporates. Because of this, it is generally encouraged that sealant not be used on the bottom or sill nailing flange 170, in order to allow for drainage and evaporation from outside.

Unfortunately, this prior art technique of window construction and installation has caused various moisture and mold problems in today's buildings. What is needed is an improved construction and installation method for windows the does not cause these problems.

SUMMARY OF THE INVENTION

The present invention prevents moisture that enters the window opening from entering the interior of the building by creating a channel behind the nailing flange of the window. Prior art windows and techniques encouraged foam insulation to be inserted between the window and the rough opening all the way to the nailing flange that is used to secure the window. This insulation prevented moisture from reaching the sill, from which it could drain or evaporate. Instead, the foam directed the water into the interior of the building. Alternatively, water that did reach the sill could become trapped behind the insulation and be prevented from draining or evaporating. In this case, the water may cause rotting inside the framing.

The present invention creates a barrier in the space between the window and the rough opening that prevents the foam from reaching the nailing flange. On the interior side of this barrier, the foam is installed normally. On the exterior side of this barrier a channel is created. This channel preferably runs around the circumference of the window. The channel allows water that enters behind the nailing flange the ability to drain down to the window sill where it can drain or evaporate.

To form the barrier, a gasket can be constructed around the perimeter of the window. This gasket is sized to engage the rough opening, such that it forms a barrier running from the window to the rough opening. Alternatively, the gasket can be sized to extend at least half way into the space between the window and the opening.

The gasket can be attached to the window during window manufacture. Alternatively, the gasket can be sold separately and attached to the window at the installation site. The gasket may also be directly attached to the rough opening itself, where it will then engage the window frame when the window is installed. The gasket can be relatively straight, extending perpendicularly from the window or rough opening and then bending during window installation. Alternatively, the gasket can be curved. The curved gasket can be sized large enough to span a large space between the window and the rough opening, and can be compressed easily to span a much smaller space. If designed to engage the rough opening, the gasket should be flexible so as to bend during the insertion of the window. If actual engagement is not anticipated, the gasket can be rigid. Finally, the barrier can be formed with a disintegrating object that disintegrates once the insulation has be installed, or a wicking object that remains in the channel to block the foam insulation while still allowing water to reach the sill.

DETAILED DESCRIPTION OF THE INVENTION

Recognition of the Problem

Figure 1:
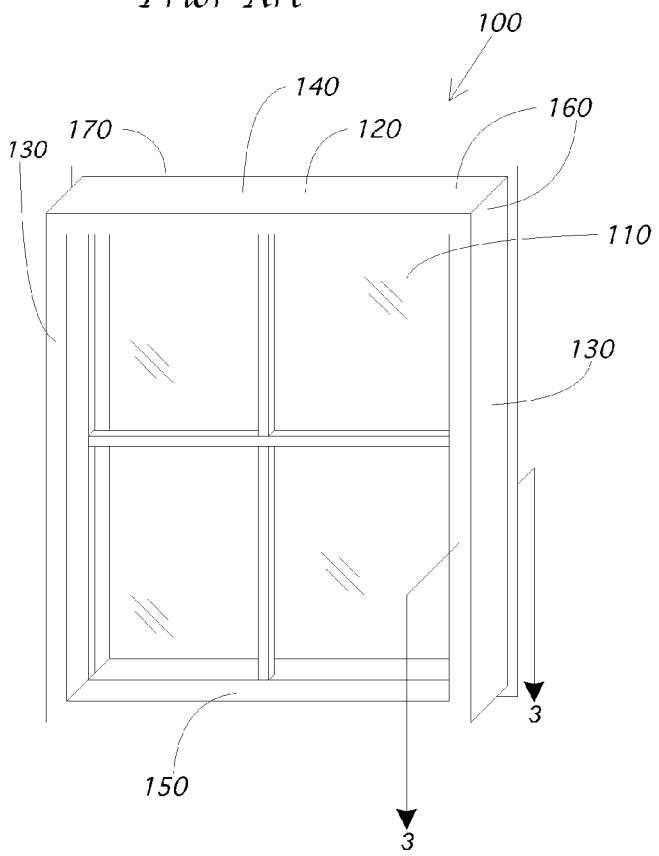
Figure 1 Prior Art
FIG. 1 is a perspective view of a prior art window.
Figure 3:
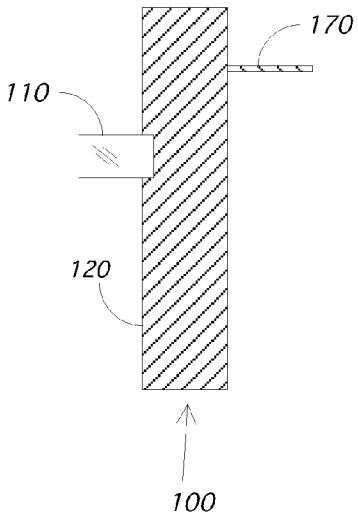
Figure 3 Prior Art
FIG. 3 is a sectional view of a portion of the window of FIG. 1 along line 3-3.
Figure 2:
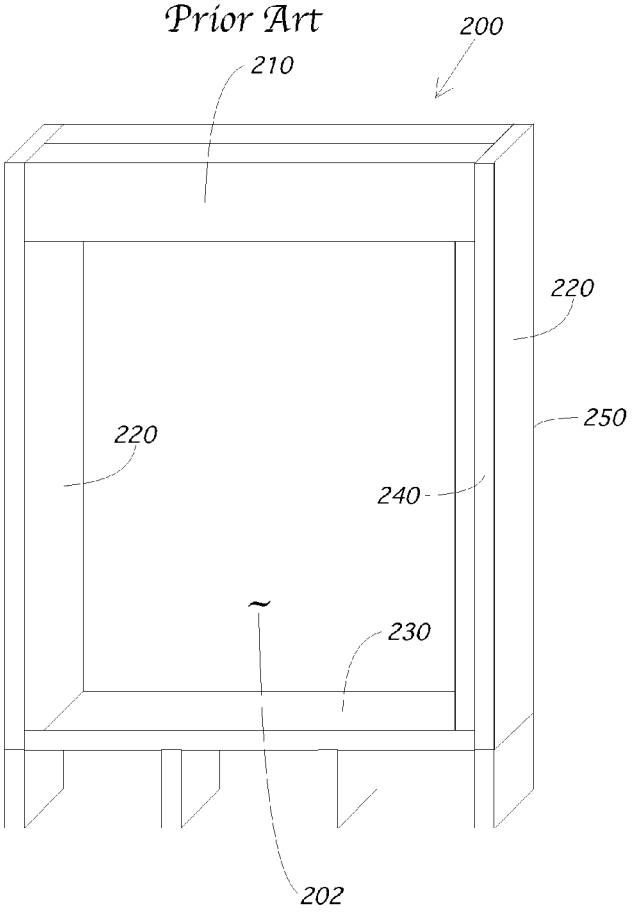
Figure 2 Prior Art
FIG. 2 is a perspective view of a rough opening for a window.
Figure 4:
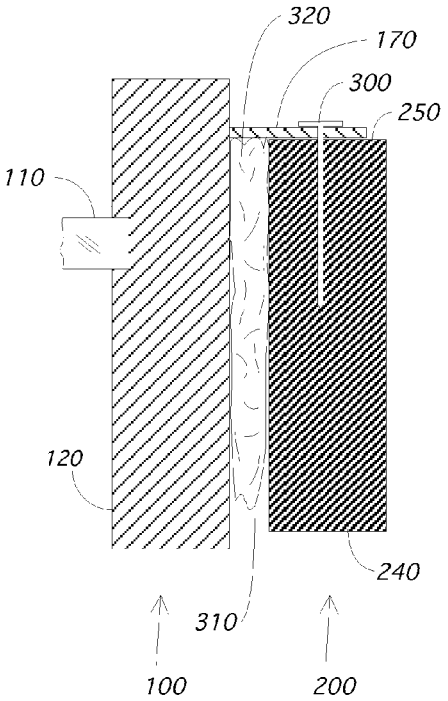
Figure 4 Prior Art
FIG. 4 is a sectional view of the portion of the window shown in FIG. 3 attached to the rough opening of FIG. 2.

The inventor of the present invention has discovered a significant problem with prior art windows and installation techniques as illustrated in FIGS. 1, 2, 3 and 4 and described above. As explained above, the current thinking in window and building construction allows moisture that enters the window cavity to drain and evaporate at the sill. For this approach to function adequately, three requirements must be met. The moisture that enters the window cavity 202 must be able to flow down to the sill 230. The sill 230 must be properly constructed to ensure a waterproof surface. And, the sill must be able to either drain the moisture to the outside 250 of the building, or must have enough ventilation to allow evaporation.

Unfortunately, the construction technique described above does not allow the first requirement to be met. Moisture will often enter into the window cavity 202 at the top 120 and sides 130 of the window 100. Assuming that there is no failure in the window itself, the moisture enters at these locations under the nailing flange 170. While the sealant applied under the flange 170 should help prevent this, gaps or cracks in the sealant are inevitable. The moisture that seeps under the nailing flange 170 will enter the space 310 between the window 100 and the rough opening 200. At this point, the foam 320 that was installed all the way to the nailing flange 170 will interfere with the ability of the moisture to find its way down to the sill 230. The problem is that the foam material 320 is permitted to fill the space 310 all the way to the nailing flange 170. At some point, the foam 320 will form a blockage against the nailing flange 170, and prevent any further downward movement of the moisture toward the sill 230. In addition, since the foam insulation 320 is never perfectly formed, cracks and gaps in the foam 320 form passageways that permit the water to move toward the interior 240 of the rough opening 200. In fact, once the foam insulation 320 has formed a blockage with the nailing flange 170, the only place for the water to go is toward the interior of the building. There the water remains, leading to water damage and molding issues.

First Embodiment of the Solution

The present invention involves a plurality of techniques to ensure that the foam material 320 that is applied from the interior 240 of a building in the space 310 between the window 100 and the rough opening 200 is not allowed to reach the nailing flange 170. By doing so, a channel or gap is created between the insulation 320 and the flange 170 that allows all moisture that enters anywhere around the edge of the window 100 to drain properly to the sill 230.

Figure 5:
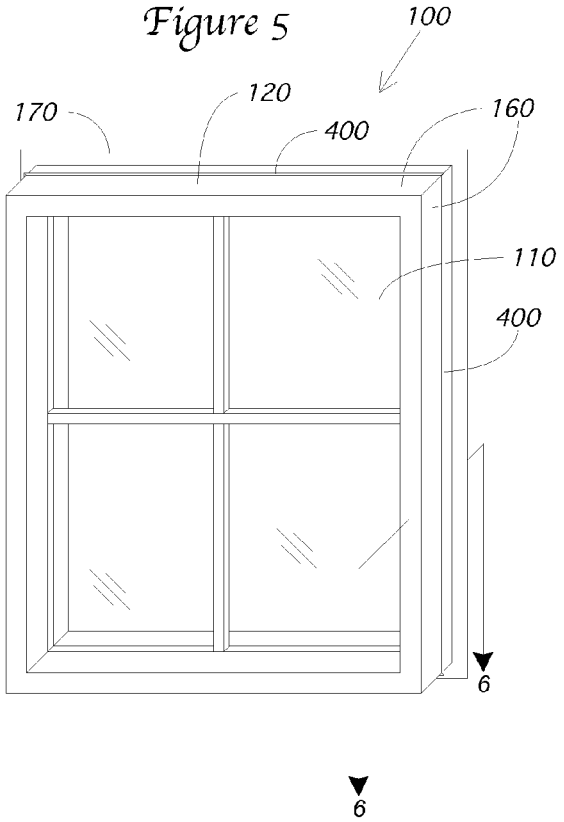
FIG. 5 is a perspective view of a window of the present invention.

The first such technique is shown in FIG. 5. There a standard window 100 with a nailing flange 170 has been fitted with a gasket 400 around its circumference. This gasket 400 can be placed on each of the four peripheral faces 160 of the window frame 120, and is positioned between the nailing flange 170 and the interior surface of the window 100. While installing the gasket 400 around all four faces 160 of the window 100 is preferred, it is well within the scope of the present invention to install the gasket 400 on less than all of the circumference of the window. For instance, an installer or window manufacturer may refrain from installing the gasket 400 along the sill edge 150 of the window 100 to allow easier drainage at the sill 230 of the opening 200. However, this is generally not preferred as foam material 320 that reaches the nailing flange 120 at the sill 230 can also prevent proper drainage of moisture. Modern building codes require the foam material 320 to complete the vapor barrier on all sides of a window 100, and therefore the gasket 400 is preferably used on all sides as well.

Figure 6:
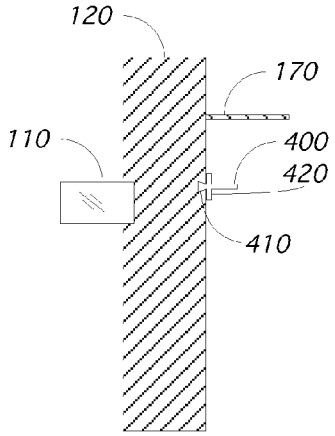
FIG. 6 is a sectional view of a portion of the present invention window of FIG. 5 taken along line 6-6.

As shown in the cross-sectional view in FIG. 6, gasket 400 projects away from the window frame 120, but does not extend as far as the nailing flange 170. The purpose of the gasket 400 is to approach or engage the rough opening 200 when the window 100 is installed. The flexible gasket 400 can be formed and attached to the window frame in a variety of ways. In FIG. 6, it is shown that the gasket 400 is formed with a tongue 410 that fits into a groove in the window frame 120. This tongue-and-groove connection is designed to prevent the gasket 400 from moving or otherwise disengaging with the window frame 120 during the installation of the window 100. Of course, other protrusion and channel combinations could be used equally as well as the tongue and groove shown in FIG. 6, including protrusions on the window frame 120 that extend into channels or grooves on the gasket 400.

In a first embodiment, the gasket 400 engages and flexes against the opening 200 when the window 100 is inserted into the window. To help assist the tongue-and-groove fitting in securing the gasket 400, the gasket 400 is also formed with a base section 420 that abuts the window frame 200. This base section helps keep the gasket 400 relatively perpendicular vis a vis the exterior surface of the window frame 200. When designed to engage the opening 200, it is important to manufacture the gasket 400 out of a significantly flexible material to allow the gasket 400 to bend during insertion.

One advantage of permanently attaching the gasket 400 on the peripheral faces 160 of the window 100 is that the gasket 400 can be added during the construction of the window 100 itself. In this way, the window manufacturer can be responsible for securely attaching the gasket 400. The window 100 is then delivered to the construction site with the gasket attached, where the window installer can install the window 100 and gasket 400 combination in much the same as any ordinary window 100. Window manufacturers may use any known technique to attach the gasket 400 to the window 100, including protrusions and channels, or by nailing or stapling the gasket 400 directly to the window frame 120. Alternatively, the gasket can be formed as an integral part of the window frame 120 itself.

Figure 7:
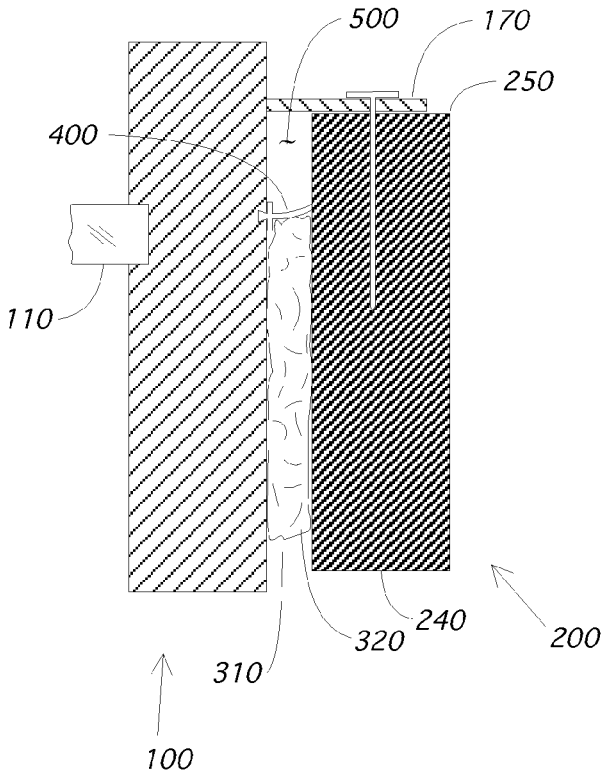
FIG. 7 is a sectional view of the portion of the present invention window shown in FIG. 6 attached to the rough opening of FIG. 2.

As shown in FIG. 7, the gasket 400 of this first embodiment will preferably contact the framing of the rough opening 200, such as side 220, thereby dividing the space 310 between the window 100 and the opening 200 in two. The portion of the space 310 closest the interior 240 of the building can be used for the foam material 320. As the foam 320 is installed, it can be installed all the way up to the gasket 400. This is similar enough to the prior art technique of installing the foam 320 all the way up to the nailing flange 170 so as to not require any significant change in foam installation techniques.

The other portion of the space 310 divided by the gasket 400 is the gap or channel 500 formed adjacent the nailing flange 170. Because the gasket 400 is formed on at least the top 140 and sides 130 of the window frame 120, the formed channel 500 is ensured of existing at these locations as well. In this way, the gasket 400 will allow for any moisture that penetrates the opening around a window 100 to have the proper channel 500 to continue its movement down toward the sill 150 and ultimately out to the exterior 250 of the building. In addition, the gasket 400 itself serves as a barrier to any water or moisture that enters the channel 500, and helps to prevent that water from entering into the interior or framing of the building.

In this embodiment an entire width of the gasket structure 400 from one side 130 to the other side 130 of the window 100 is slightly larger than that of the largest recommended rough opening 200, as defined by the window manufacturer. The gasket 400 should also be large enough to account for a non-centered window 100, so that the gasket 400 will still engage the opening 200. The gasket 400 should be rigid enough to hold its position in space 310 against insulation 320, yet be flexible enough to handle a small space 310 that might be created in a non-centered window 100. The flexibility should also be great enough so as not to hinder the simple installation of a window. In the preferred embodiment, the gasket 400 can be constructed of almost any material that can meet these basic properties, including open or closed cell foam plastics, natural or synthetic rubber, or the like. If a rigid gasket 400 is to be used, the choice of materials would be even broader, including wood, metal, and hard plastics.

Figure 8:
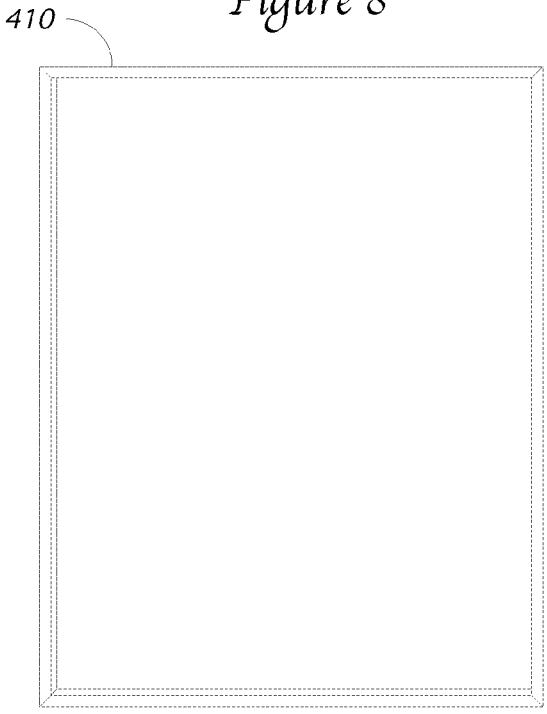
FIG. 8 is a perspective view of a second embodiment of the present invention detached from a window.
Figure 9:
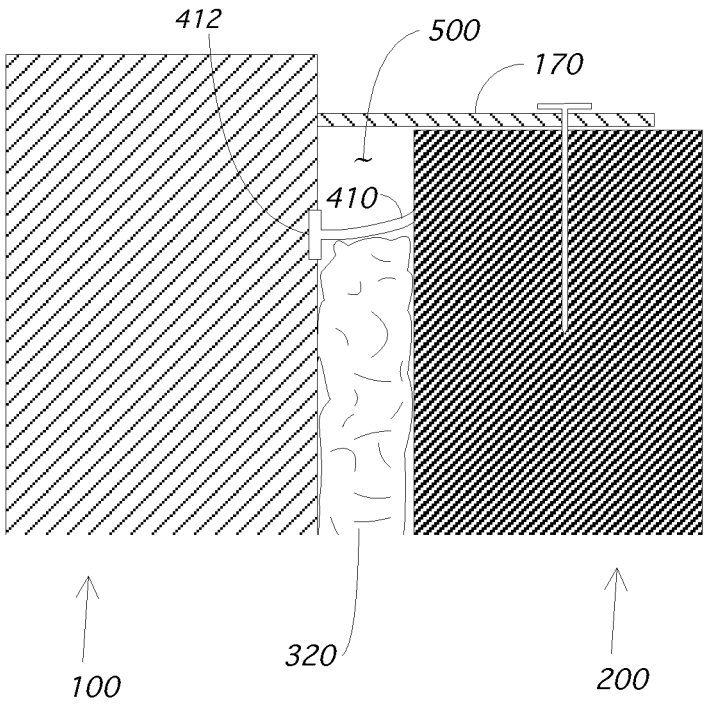
FIG. 9 is a sectional view of the second embodiment being used on a window in a rough opening.

FIG. 8 shows a second embodiment of the present invention gasket 410. This gasket 410 can be manufactured in one piece and sized for a particular window 100. The gasket 410 can then be applied to the window 100 at the installation site. Preferably, the gasket 400 is applied over the window frame 120 from the interior side. As shown in the cross-sectional view in FIG. 9, the window 100 can be formed with a groove 412 for receiving the gasket 410. Once the gasket 410 is installed in the groove 412, it can either be nailed or stapled in place by the installer, or the elasticity of the gasket 410 can be relied to keep it in place. When installed, this second embodiment of the gasket 410 functions similar to gasket 400, as can be seen by comparing FIG. 9 with FIG. 7.

Figure 10:
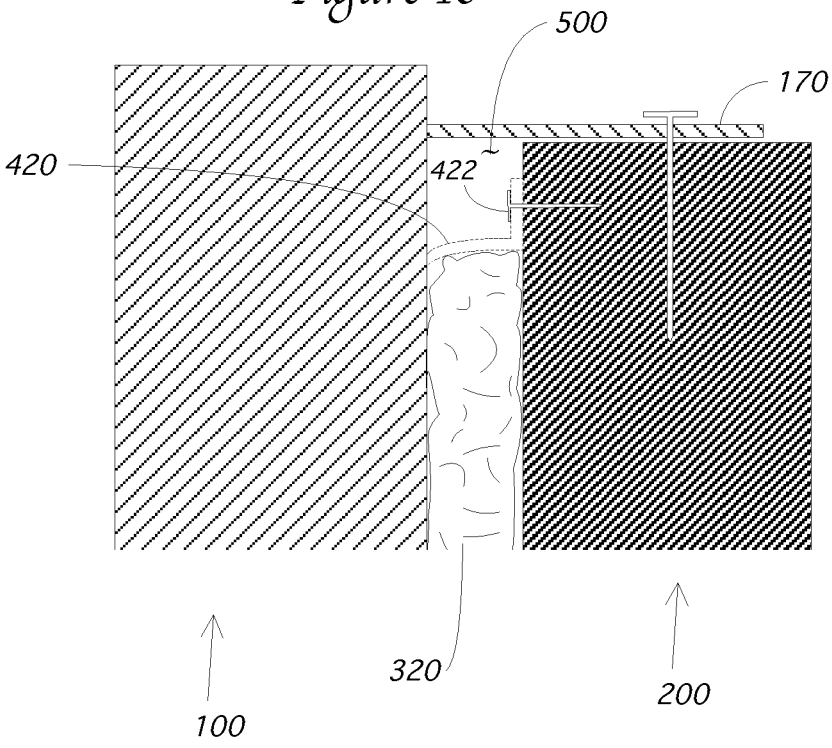
FIG. 10 is a sectional view of a third embodiment of the present invention being used in connection with a window in a rough opening.

Alternatively, a gasket 420 can be created that is designed to be installed directly onto the rough opening 200, as shown in FIG. 10. In this Figure, the gasket 420 has been nailed to the opening 200 with a plurality of nails 422, only one of which is shown in FIG. 10. Alternatively, gasket 420 can be attached with staples or adhesive to the opening 200. This gasket 420 can be provided to window installers in strips, which can then be cut to the size of the opening 200. Once the gasket 420 has been attached to the opening, the window 100 can be inserted. The frame 120 of the window 100 will then engage the gasket 420, much like how the rough opening 200 engaged gaskets 410 and 400 during the window insertion process described above. Like the other embodiments 410, 400, gasket 420 functions by forming a gap or channel 500 for the drainage of moisture and water. The gasket 420 further functions to prevent water from entering the interior of the house, and serves to prevent the insulation 320 from impeding the flow of moisture in the channel 500.

Figure 11:
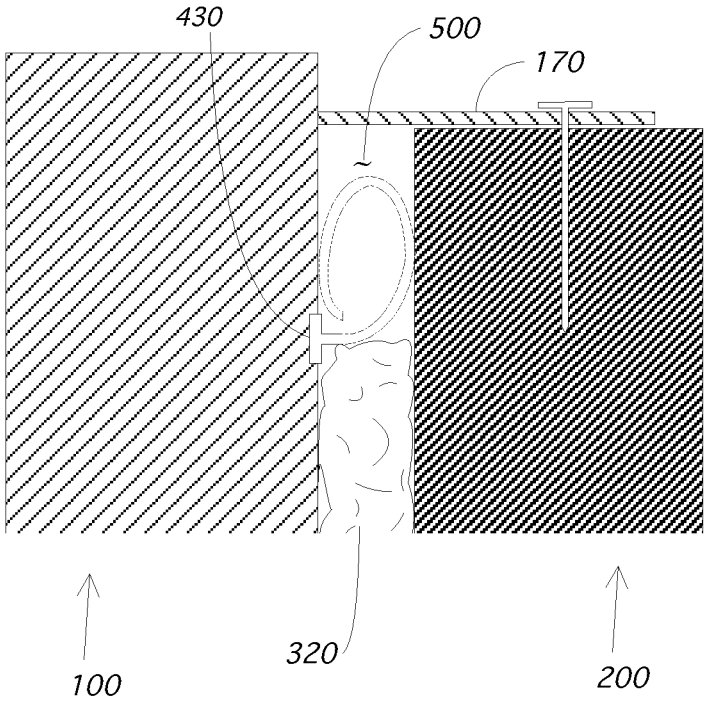
FIG. 11 is a sectional view of a fourth embodiment of the present invention in which the gasket has a rounded shape that is easily compressed.

FIG. 11 shows another embodiment of a gasket 430 that can be used to create channel 500. In this case, the gasket 430 has a rounded shape that is easily compressed. This allows the gasket to fill a relatively large space 310 between the window and the rough opening 200, while still being able to easily be compressed for a smaller space 310. This shape is called rounded in this invention description, and is defined by having a gasket that forms at least 270 degrees of a complete circle.

Figure 12:
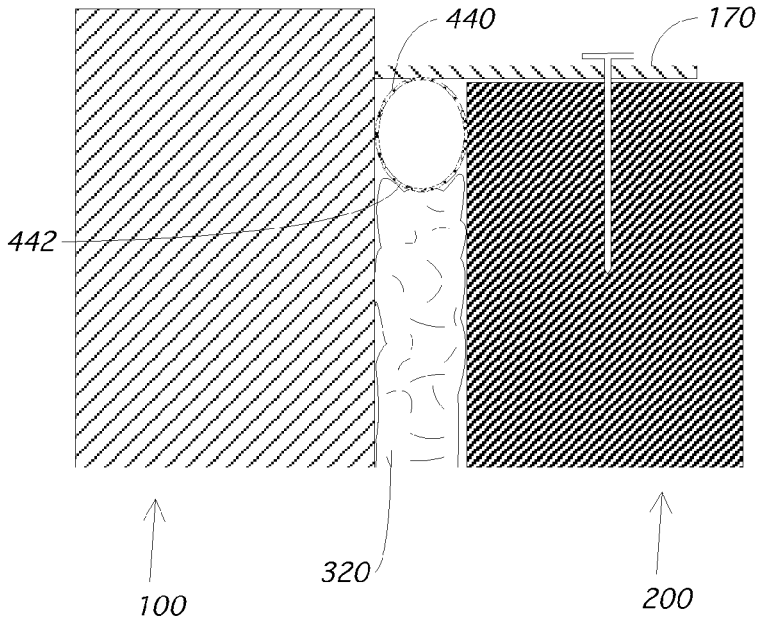
FIG. 12 is a sectional view of a fourth embodiment of the present invention showing a decomposing article being used in connection with a window in a rough opening.
Figure 13:
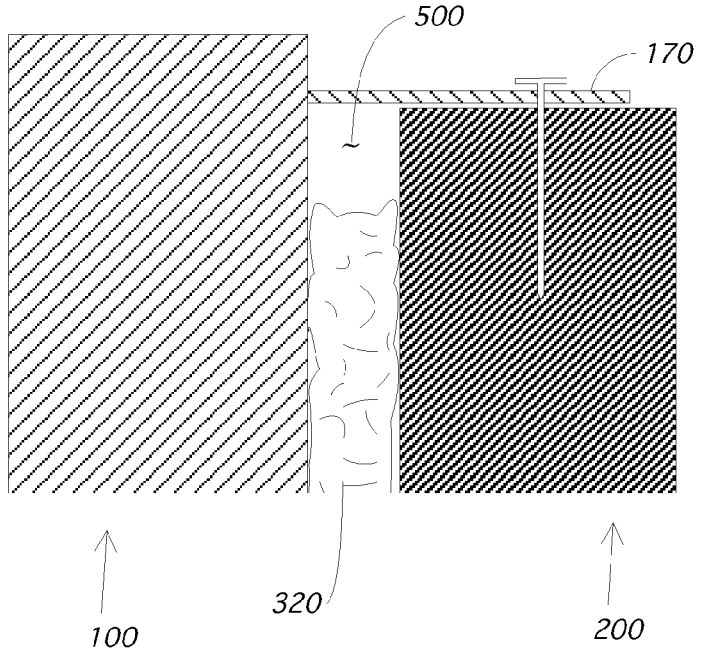
FIG. 13 is a sectional view of the fourth embodiment after the decomposing article has decomposed.

FIG. 12 shows a fifth embodiment, in which a decomposing object 440 is placed adjacent to the nailing flange 170 after the window 100 is installed in the rough opening 200. This object 440 has an interior face 442, which servers to block the foam 320 from abutting the nailing flange 170 when the foam material 320 is injected into the space 310 between the window 100 and the rough opening 200. To form channel 500, the object 440 will then disintegrate, leaving only the channel 500, as is shown in FIG. 13. Such an object 440 can be created using an inflatable balloon. The balloon can be inserted into the space 310 either already inflated or deflated (which is then inflated in place). The size of the balloon will easily conform to the shape of the space 310, and can be pressed to abut the nailing flange 170. When the insulation 320 is injected into space 310, the interior face 442 of the balloon 440 will prevent the foam 320 from reaching the nailing flange 170. When the foam insulation 320 has firmed up, the balloon can be deflated using a long thin pin inserted through the insulation 320. Alternatively, the balloon 440 can be design to deflate over time. Furthermore, a portion of the balloon 440 can be secured to the header 210 to prevent the deflated balloon from interfering with water flow in the channel 500. Other disintegrating objects 440 can be used, either now known or hereinafter developed. Ideally, the disintegrating object 440 will have an interior face 442 that can impede the flow of injected insulation 320, and will disintegrate completely soon after the insulation 320 has firmed or solidified.

Figure 14:
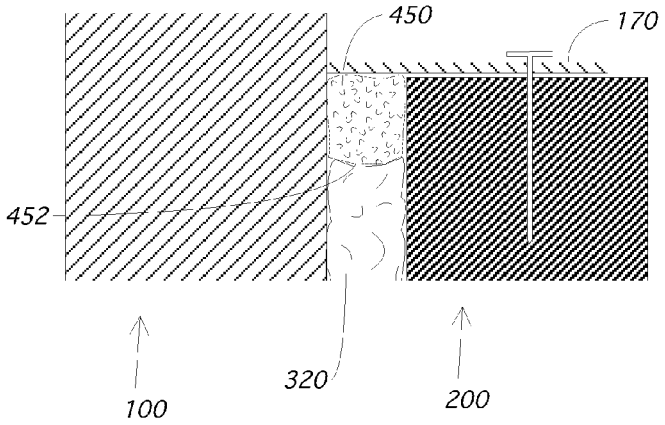
FIG. 14 is a sectional view of a fifth embodiment of the present invention showing the use of a wicking article.

Another embodiment of the present invention is to replace the disintegrating object 440 with a wicking object 450, as shown in FIG. 14. The wicking object would be placed in space 310, and would impede the flow of the insulation 320 at face 452, just like the disintegrating object 440 shown in FIG. 12. However, the wicking object would not disintegrate after the foam 320 is installed, but would be designed to wick moisture around the window frame 120 toward the sill 230 of the rough opening 200. In effect, the entire channel 500 would remain, but would stay filled with the wicking object 450. The wicking object 450 would not impede the flow of moisture to the sill 230, but would help wick the moisture to the sill 230. The wicking object 450 could be made of a material that conveys the moisture via capillary action. Alternatively, the wicking object 450 could be formed of any material that would allow the flow of water while impeding the flow of foam 320. For instance, the wicking object 450 could be formed of a porous, fibrous material that does not use capillary action but does allow water flow. One example of such a material is the Home Slicker® product sold by Benjamin Obdyke Incorporated, Horsham, Pa. Alternatively, traditional fiberglass insulation can be used since water is not absorbed by the glass fibers found in fiberglass insulation. Water that enters channel 500 would flow through the fiberglass fibers 450 down to the sill 230.

Figure 15:
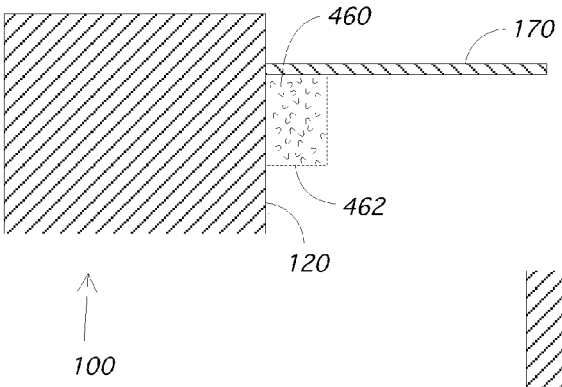
FIG. 15 is a sectional view of a sixth embodiment of the present invention showing the use of a wicking element attached to the nailing flange of the window.
Figure 16:
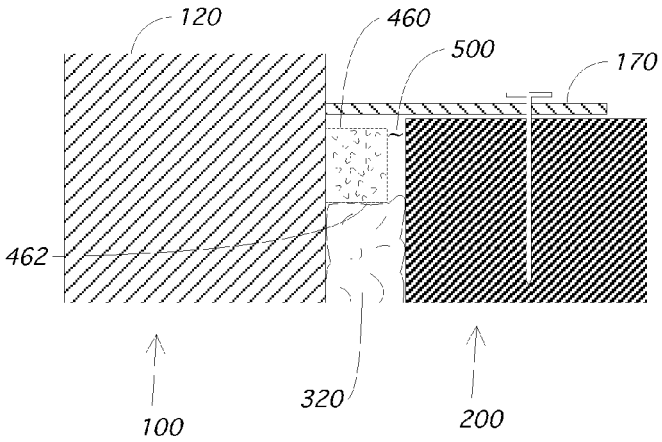
FIG. 16 is a sectional view of the sixth embodiment of FIG. 15 being used in connection with a window in a rough opening.

FIG. 15 shows a sixth embodiment of the present invention in which a wicking strip 460 is attached directly to the window frame 120. In the preferred embodiment, the wicking strip 460 abuts against both the nailing flange 170 and the main portion of the window frame 120. Alternatively, the wicking strip 460 could be attached to only one of these portions 120, 170 of the window 100, so long as the strip 460 is positioned near both the nailing flange 170 and the window frame 120. This wicking strip 460 will allow moisture to pass through it while impeding the progress of foam 320, as shown in FIG. 16. Notice that the strip 460 in FIG. 16 is not attached directly to the nailing flange 170. The wicking strip 460 acts to stop the foam 320 at face 462 while partially filling gap 500. As with the wicking object 450 that is positioned in the gap 500, the wicking strip 460 that is pre-attached to the window 100 can move water through capillary action or by being a porous material that allows water to pass through. The moisture that enters gap 500 can flow down through the unfilled portion of the gap 500 or through the wicking strip 460 of the window frame 120. The wicking strip 460 should be sized so as to position the barrier face 462 at a sufficient distance from the nailing flange so as to prevent the foam 320 from reaching the nailing flange 170 even when a portion of the gap 500 is not filled by the wicking strip 460.

Figure 17:
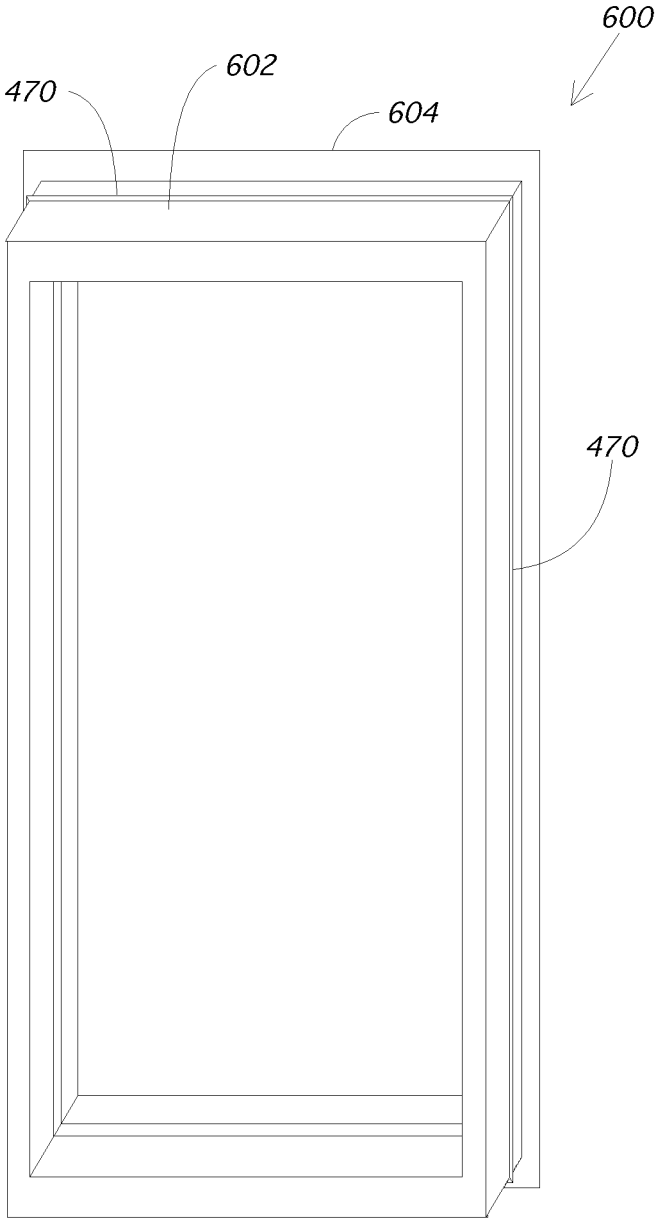
FIG. 17 is a perspective view of a door frame of the present invention.

The present invention is not limited to window frames 120, but would be equally applicable to any framed item that is inserted into an opening of a building. For instance, FIG. 17 shows a door 600 having a door frame 602. This door 600 is also fitted with a nailing flange 604, although such a flange would not be necessary for this invention. The gasket 470 of the present invention is attached to the periphery of the door frame 602, preferably at least on the top and side of the door frame. This gasket 470 would function similar to the barriers 400-460 described above.

Figure 18:
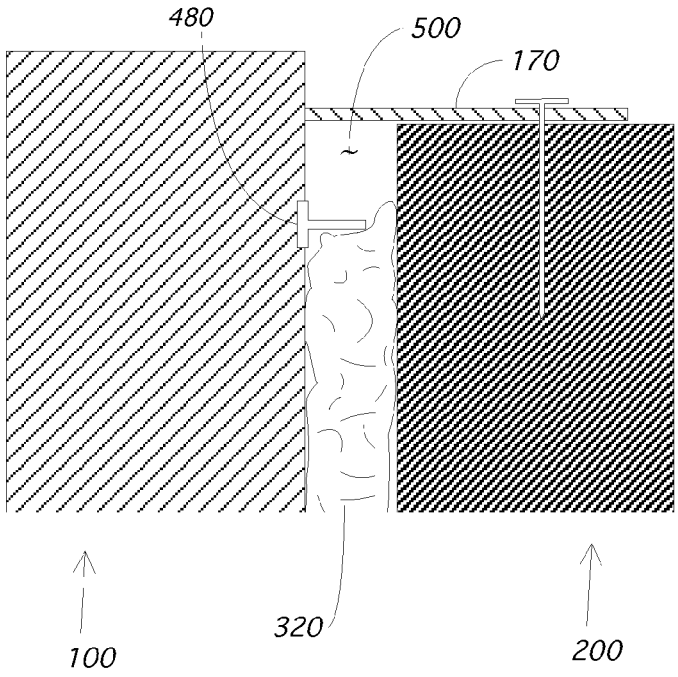
FIG. 18 is a sectional view of a seventh embodiment of the present invention being used on a window in a rough opening.

FIG. 18 shows yet another embodiment of the present invention in gasket 480. As shown in this figure, gasket 480 does not completely extend from window 100 to frame 200. Nonetheless, the gasket 480 serves as a sufficient barrier to foam material 320 so as to create the same gap 500 as was created in the other embodiments. In this case, the foam material 320 extends somewhat into the gap, but not significantly. The foam material 320 would be considered to extend significantly into the gap if the foam 320 came into contact with the nailing flange 170. When the gasket 480 does not engage another surface, it is possible for the gasket 480 to be constructed of a rigid material. Preferably, this gasket 480 will extend at least half way across the space between the window 100 and the frame 200.

Figure 19:
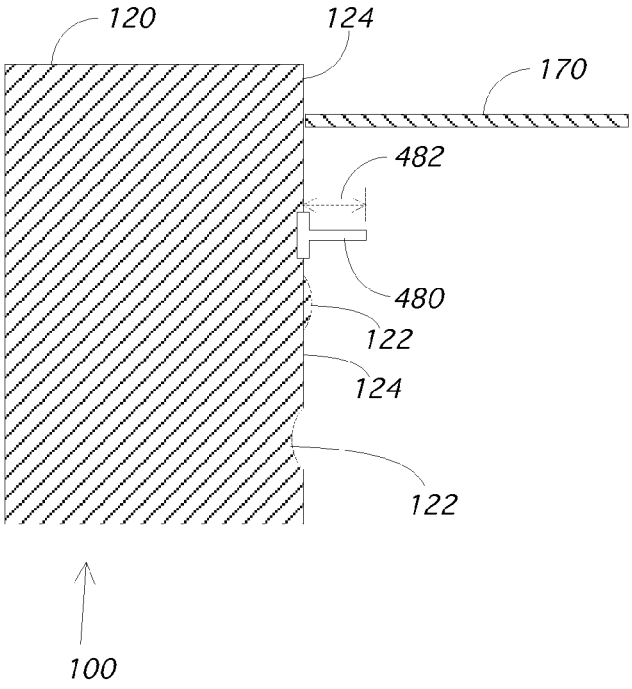
FIG. 19 is a section view showing the length of the seventh embodiment from FIG. 18.

Window frames 120 may be completely smooth on their exterior jamb surfaces, or they may have minor bumps and ridges 122 as shown in FIG. 19. These irregularities 122 on the relatively planar 124 face of the window frame 120 do not significantly impede the flow of foam 320 that is inserted into gap 310 between the roughed opening 200 and the window frame 120. To impede the foam 320 and serve as a barrier as described above, the barrier 480 should extend significantly into the gap 310, which is not the case with irregularities 122. Typically, window manufacturers require a minimum one-quarter to three-eighth of an inch between the window frame 120 and the roughed opening 200. Because this distance might be greater, it is preferred that the barrier 480 extend away from the generally planar face 124 of the window frame by a distance 482 approximately equal to this minimum distance. Consequently, one way of measuring the size of the barrier 480 of the present invention is by this distance 482, which ideally is at least 0.20 inches.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A method of installing a framed object having sides into a rough opening of a building, the method comprising:

a) inserting the framed object into the rough opening creating a space between the sides of the framed object and the rough opening, the framed object having a flexible barrier attached to a plurality of the sides of the framed object;

b) during the insertion step, creating contact between the rough opening and at least a first portion of the flexible barrier thereby causing the first portion of the flexible barrier to bend during insertion;

c) fixing the framed object in the rough opening so that the first portion of the flexible barrier remains in a bent position, whereby the flexible barrier extends into the space and divides the space into an external channel on an external side of the flexible barrier and an internal space on an internal side of the flexible barrier; and d) after inserting the framed object into the rough opening, inserting foam into the internal space up to and abutting the flexible barrier, wherein the flexible barrier blocks the foam from filling the external channel.

2. The method of claim 1, wherein the flexible barrier is not attached to a sill side of the framed object and is attached to all other sides of the framed object.

3. The method of claim 1, wherein the flexible barrier extends away from the sides of the framed object to define a flexible barrier area having at least one dimension larger than a corresponding dimension of the rough opening, thereby ensuring that the insertion step causes a bending of at least one portion of the flexible barrier.

4. The method of claim 1, wherein the flexible barrier is a one-piece gasket that is stretched around a periphery of the framed object in order to attach the flexible barrier to the sides of the framed object.

5. The method of claim 1, wherein the flexible barrier comprises a base portion and a flexible extension extending away from the base portion by at least 0.20 inches.

6. The method of claim 5, wherein the base portion and the flexible extension are both constructed of a single material chosen from a set comprising open cell plastic, closed cell plastic, natural rubber, and synthetic rubber.

7. The method of claim 6, wherein the base portion and the flexible extension are formed integrally together with a relatively uniform thickness, and further wherein the flexible extension extends from a center part of the base portion, thereby forming a "T" shaped cross-section to the flexible barrier where the flexible extension meets the base portion.

8. The method of claim 6, wherein the base portion and the flexible extension are formed integrally together with a relatively uniform thickness, and further wherein the flexible extension extends from one edge of the base portion, thereby forming an "L" shaped cross-section to the flexible barrier where the flexible extension meets the base portion.

9. A window unit for insertion into a rough opening of a building, the window unit having an interior surface and an exterior surface, the window unit comprising:

a) a glass pane;

b) a window frame having side walls surrounding the glass pane;

c) a nailing flange attached to a plurality of the side walls proximal to the exterior surface of the window unit; and d) a flexible barrier attached to a plurality of the side walls in a position more proximal to the interior surface than the nailing flange, the flexible barrier extending away from the side walls and having sufficient flexibility to bend during insertion of the window unit into the rough opening of the building;

wherein the flexible barrier comprises a base portion and a flexible extension extending away from the base portion by at least 0.20 inches; and further wherein the base portion and the flexible extension are both constructed of a single material chosen from a set comprising open cell plastic, closed cell plastic, natural rubber, and synthetic rubber.

10. The window unit of claim 9, wherein the flexible barrier is not attached to a sill wall of the window unit and is attached to all other side walls of the window unit.

11. The window unit of claim 9, wherein the flexible barrier is a one-piece gasket that is stretched around a periphery of the window unit in order to attach the flexible barrier to the side walls of the window unit.

12. The window unit of claim 9, wherein the base portion and the flexible extension are formed integrally together with a relatively uniform thickness, and further wherein the flexible extension extends from a center part of the base portion, thereby forming a "T" shaped cross-section to the flexible barrier where the flexible extension meets the base portion.

13. The window unit of claim 9, wherein the base portion and the flexible extension are formed integrally together with a relatively uniform thickness, and further wherein the flexible extension extends from one edge of the base portion, thereby forming an "L" shaped cross-section to the flexible barrier where the flexible extension meets the base portion.

* * * * *